US008726421B2

(12) United States Patent
Alvarez

(10) Patent No.: US 8,726,421 B2
(45) Date of Patent: May 20, 2014

(54) APPAREL WITH INFLATABLE NECK CUSHION

(76) Inventor: Roberto R. Alvarez, Chicago, IL (US)

( * ) Notice: Subject to any disclaimer, the term of this patent is extended or adjusted under 35 U.S.C. 154(b) by 26 days.

(21) Appl. No.: 13/372,442

(22) Filed: Feb. 13, 2012

(65) Prior Publication Data

US 2013/0205471 A1 Aug. 15, 2013

Related U.S. Application Data

(63) Continuation-in-part of application No. 29/405,629, filed on Nov. 3, 2011, now Pat. No. Des. 675,807.

(51) Int. Cl.
*A42B 5/00* (2006.01)

(52) U.S. Cl.
USPC ..... 2/207; 5/636

(58) Field of Classification Search
USPC ..... 2/207, 69, 174, 114, DIG. 10, DIG. 3, 2/102; 5/639, 636, 637, 646, 644, 5/413 AM; 297/393, DIG. 8; 441/118
See application file for complete search history.

(56) References Cited

U.S. PATENT DOCUMENTS

| | | | |
|---|---|---|---|
| 552,670 | A | 1/1896 | Riess |
| 891,166 | A | 6/1908 | Harrison |
| 1,176,482 | A | 3/1916 | Orme |
| D58,857 | S | 8/1921 | Wishnefsky |
| D126,586 | S | 4/1940 | Kasarda |
| 2,246,035 | A | 6/1941 | Elliot |
| D142,469 | S | 10/1945 | Brodigan |
| 2,452,972 | A | 11/1948 | Von Rodenstein |
| 2,496,953 | A | 2/1950 | Pinnere |
| 2,795,802 | A | 6/1957 | Myers |
| 2,870,448 | A | 1/1959 | Rosenthal |
| 3,926,181 | A | 12/1975 | Eischen |
| 4,097,086 | A | 6/1978 | Hudson |
| 4,277,859 | A | 7/1981 | Seaman |
| 4,285,081 | A | 8/1981 | Price |
| D292,542 | S | 11/1987 | Slimmon |
| 4,712,259 | A | 12/1987 | Chiasson |
| 4,726,085 | A | 2/1988 | Antonio |
| 4,768,247 | A | 9/1988 | Beier |
| 4,979,249 | A | 12/1990 | Meade, II |
| D315,640 | S | 3/1991 | Pelzel |
| D328,683 | S | 8/1992 | Kalozdi |

(Continued)

OTHER PUBLICATIONS

Burton Flight Hoodie, available at http://www.highsnobiety.com/news/2007/02/02/burton-flight-hoodie/, dated Feb. 2, 2007, last visited Feb. 13, 2012.

*Primary Examiner* — Khoa Huynh
*Assistant Examiner* — Khaled Annis
(74) *Attorney, Agent, or Firm* — Beem Patent Law Firm

(57) ABSTRACT

A neck supporting piece of apparel, such as a scarf, which includes an inflatable bladder in a neck portion and a tube coupled to the bladder and extending downward to a port easily accessible by the user while wearing the apparel in order to inflate and deflate the bladder, which serves as a neck cushion or pillow. While the neck portion may be configured to go behind the user's neck, the apparel also may include a connector to join the apparel together in front of the user, helping to keep the cushion formed around the user's neck. In addition, the scarf may include pockets at a position generally where the user's hands would lie when sitting or standing, such that tensioning the scarf with the user's arms may increase the cushioning effect of the pillow.

18 Claims, 3 Drawing Sheets

(56) References Cited

U.S. PATENT DOCUMENTS

| | | | | |
|---|---|---|---|---|
| D361,916 | S | 9/1995 | Walton | |
| 5,471,690 | A | 12/1995 | McNeil | |
| D376,252 | S | 12/1996 | Herring-Stanger | |
| D380,119 | S | 6/1997 | Gonzalez | |
| D381,545 | S | 7/1997 | Muttick et al. | |
| 5,645,319 | A | 7/1997 | Parks, Jr. | |
| D387,186 | S | 12/1997 | Drone | |
| 5,697,102 | A | 12/1997 | Benjamin | |
| 5,771,514 | A | 6/1998 | Wilhoit | |
| D398,735 | S | 9/1998 | Bryant | |
| 5,948,013 | A | 9/1999 | Swezey et al. | |
| D419,024 | S | 1/2000 | Lenahan et al. | |
| 6,009,577 | A | 1/2000 | Day | |
| 6,010,192 | A | 1/2000 | King | |
| D420,845 | S | 2/2000 | Rumage | |
| 6,122,784 | A | 9/2000 | Hurwitz | |
| 6,151,735 | A | 11/2000 | Koby et al. | |
| 6,216,298 | B1 | 4/2001 | Oliveira | |
| 6,230,349 | B1 | 5/2001 | Silver et al. | |
| 6,301,714 | B1 | 10/2001 | Son | |
| 6,327,712 | B1 | 12/2001 | Armstrong | |
| 6,327,725 | B1 | 12/2001 | Veilleux et al. | |
| D453,653 | S | 2/2002 | Tunnell | |
| 6,510,574 | B2 | 1/2003 | Sharrock et al. | |
| D472,363 | S | 4/2003 | Raniere | |
| 6,622,326 | B2 | 9/2003 | Richardson | |
| 6,647,573 | B2 | 11/2003 | Corbin | |
| 6,659,552 | B2 | 12/2003 | Duncan | |
| 6,922,860 | B2 | 8/2005 | Cuddy | |
| 6,951,038 | B1 | 10/2005 | Ganoe | |
| D512,511 | S | 12/2005 | Friedland | |
| 7,004,808 | B1 * | 2/2006 | Nelson et al. | 441/106 |
| 7,059,678 | B1 | 6/2006 | Taylor | |
| 7,118,437 | B1 * | 10/2006 | Bradley et al. | 441/118 |
| D536,860 | S | 2/2007 | Hoey | |
| D582,045 | S | 12/2008 | James | |
| D583,535 | S | 12/2008 | George | |
| D594,561 | S | 6/2009 | Freeland et al. | |
| 7,578,015 | B1 | 8/2009 | Wilson et al. | |
| D607,682 | S | 1/2010 | Presman et al. | |
| 7,644,990 | B2 | 1/2010 | Pearson | |
| D617,533 | S | 6/2010 | Douglas et al. | |
| D619,402 | S | 7/2010 | Sternlight | |
| D634,515 | S | 3/2011 | Amante | |
| 2002/0078507 | A1 | 6/2002 | Pearce | |
| 2002/0152553 | A1 | 10/2002 | Wynveen | |
| 2005/0039242 | A1 | 2/2005 | Edmondson | |
| 2005/0097673 | A1 * | 5/2005 | Matthews Brown et al. | 5/636 |
| 2007/0004298 | A1 * | 1/2007 | Ganley | 441/88 |
| 2007/0174970 | A1 * | 8/2007 | Best | 5/644 |
| 2008/0034504 | A1 | 2/2008 | Schmidt | |
| 2008/0189863 | A1 | 8/2008 | Zappas | |
| 2009/0019641 | A1 | 1/2009 | Ali | |
| 2009/0210993 | A1 | 8/2009 | Pendleton | |
| 2009/0211032 | A1 | 8/2009 | Lange | |
| 2010/0180382 | A1 | 7/2010 | Hunter | |
| 2010/0237677 | A1 | 9/2010 | Nam | |

* cited by examiner 10
12
14
15
16
17
18
20
22
24
26
28
30
32
34
36
38
40
42
44
46
48
50
52
54
56
68

APPAREL WITH INFLATABLE NECK CUSHION

This application claims the benefit of priority from U.S. Design application Ser. No. 29/405,629, filed Nov. 3, 2011.

BACKGROUND OF THE INVENTION

1. Field of the Invention

The present invention relates to apparel with one or more integrated features, such as a neck pillow, various pockets, and a chamois.

2. Description of the Related Art

A person that sits for extended periods of time, e.g., a traveler, a person with a job sitting at a desk, or a medical patient receiving treatment such as chemotherapy, dialysis, etc., may experience neck and shoulder pain from supporting his or her head without significant movement. Although the person may be able to recline slightly in his or her chair, often the degree to which the chair reclines may be limited, such that the weight of supporting the head remains.

This problem may be exacerbated if the person attempts to sleep either while sitting upright or slightly reclined. As the person sleeps, the head may fall into a position that leaves the person with a stiff neck and/or muscle soreness when the person wakes up.

Neck pillows that envelop at least a portion of the person's head are available, but these can be bulky to transport. Particularly with respect to air travelers, as airlines become more stringent on the limits of what a person can bring into the cabin of a plane, these pillows can take up valuable space in the person's luggage, and they may be bulky to store when not in use.

What is needed is a method and apparatus for neck support that overcomes the drawbacks described above.

BRIEF SUMMARY OF THE INVENTION

In one embodiment, neck-supporting apparel may include: a neck portion having an interior side and an exterior side with a pocket therebetween, a first portion extending outward from an end of the neck portion and a second portion extending outward from another end of the neck portion, an inflatable bladder configured to be disposed within the pocket, a tube operatively connected to the bladder, the tube configured to extend through a channel in the first portion, and a coupler configured to join the first portion to the second portion in front of a user. The coupler is releasably couplable to at least one of, and maybe both of, the first and second portions. The first portion may include a plurality of buttons, and the coupler may include an eyelet at one end, the eyelet configured to receive each of the plurality of buttons.

The apparel also may include an opening on the exterior side of the neck portion, the opening providing access to the pocket. In addition, the channel may extend to a port in the first portion, which may be vertically spaced at least about 6" from a median of the neck portion. In addition, the port may be on an interior side of the first portion, the apparel further comprising a cover concealing the port. The apparel further may include a hood extending from the neck portion and an external pocket on an exterior side of each of the first and second portions.

In another embodiment, a neck supporting scarf may include: a neck portion with a first arm portion and a second arm portion, a pocket on an exterior side of, and proximate a bottom of, the first arm portion and the second arm portion, an inflatable bladder disposed within the neck portion, a tube coupled at one end proximate an end of the bladder and having a valve at an opposite end, a port in one of the first and second arm portions, the port configured to receive the valve, and a channel extending from the neck portion through at least a portion of the first arm portion, the channel connecting the pocket and the port.

The scarf also may include a connector configured to couple the first and second arm portions together, and attachment means on the first and second arm portions configured to couple to the connector. The attachment means on at least one of the first and second arm portions may be disposed proximate an end of the bladder. Alternatively, the attachment means may be disposed in a position overlying the channel.

The scarf further may include a hood extending from the neck portion and a visor attached at one end to the hood and releasably attached to the hood at another end.

The bladder may flare outward toward its edges, which may provide increased lateral support, and the tube may be about 10 inches long, which may allow for easier inflation and deflation of the bladder.

In still another embodiment, neck supporting apparel may include: a neck portion having an inner radius of curvature, a plurality of arm portions extending from the neck portion, a pocket on an exterior side of each arm portion, an inflatable bladder spanning the neck portion, the bladder having a radius of curvature substantially similar to the neck portion radius of curvature, at least one button on each arm portion, the buttons disposed below the ends of the bladder, and a coupler configured to join a button on a first arm portion with a button on a second arm portion. The neck supporting apparel also may include a tube extending downward into one of the arm portions, the tube having a length about half a length of the bladder.

These and other features and advantages are evident from the following description of the present invention, with reference to the accompanying drawings.

DETAILED DESCRIPTION OF THE INVENTION

An apparatus for supporting the neck may be part of apparel 10, wearable by a user and configured to be inflated or deflated by the user whenever desired.

As shown in FIGS. 1-9, in one embodiment, the apparel 10 may comprise and may be referred to herein as a scarf. Scarf 10 may include a portion 12 configured to go behind the user's head, preferably substantially aligned with the user's neck. Scarf 10 further may include a first arm portion 14 extending from one end of neck portion 12 and a second arm portion 16 extending from an opposite end of neck portion 12. First and second arm portions may be substantially similarly shaped, although arm portions also may be distinct from one another.

Figures 1, 1A, 1B, 2, 3:
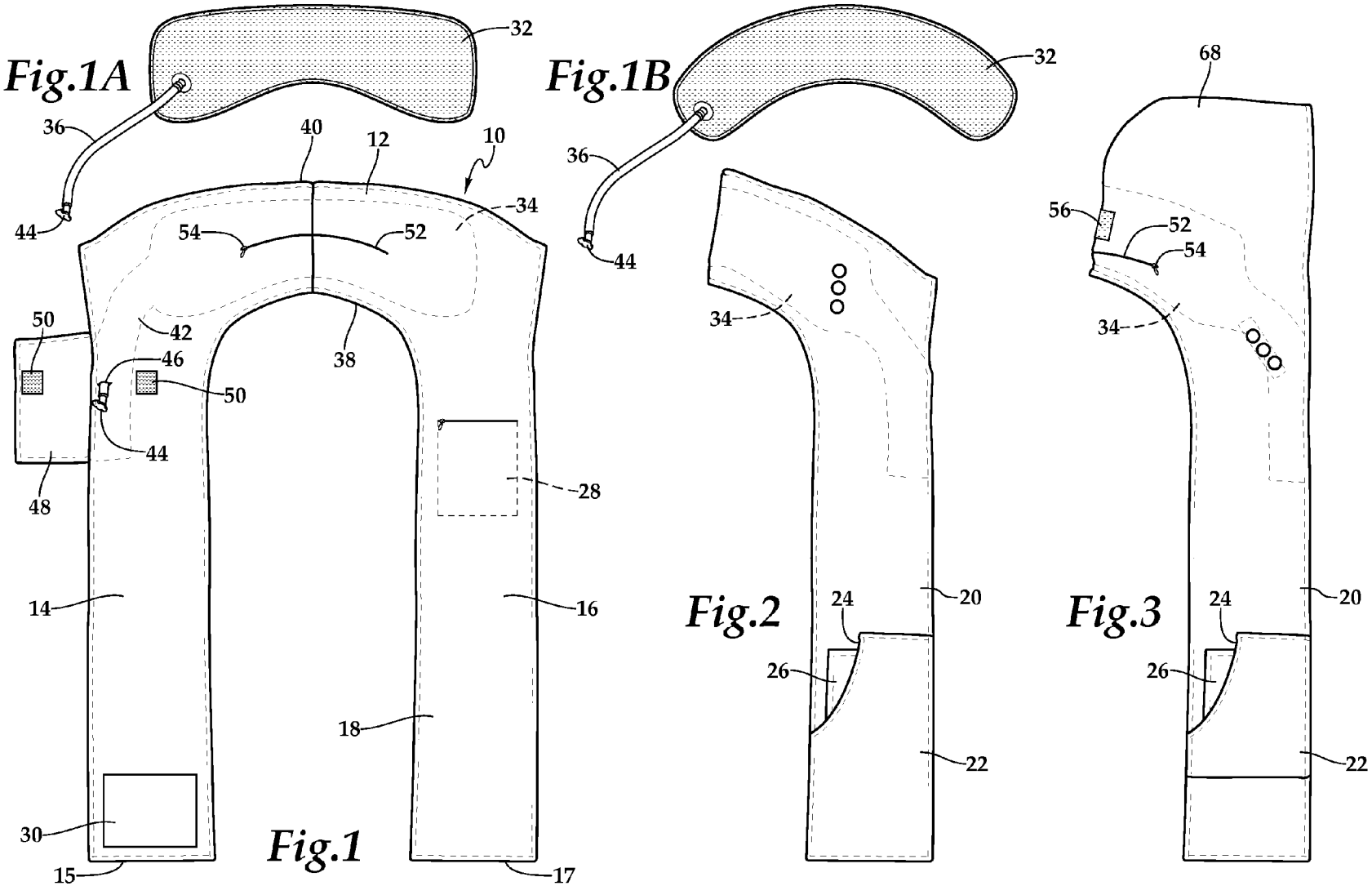
FIG. 1 is a view of the internal side of a piece of apparel with an inflatable neck cushion, the apparel in the form of a scarf.
FIG. 1A is one embodiment of a bladder and tube usable with the apparel of FIG. 1.
FIG. 1B is another embodiment of a bladder and tube usable with the apparel of FIG. 1.
FIG. 2 is a side view of the external side of the scarf of FIG. 1, the other external side generally a mirror-image thereof.
FIG. 3 is a side view of the external side of a second embodiment of a piece of apparel with an inflatable neck cushion, the other external side generally a mirror image thereof.

Arm portions 14, 16 may be substantially symmetrical to one another, although differently shaped arm portions are possible. In one embodiment, arm portions 14, 16 each are about 7" wide. Arm portions 14, 16 also may have a generally constant width between neck portion 12 and first and second ends 15, 17, respectively, as seen in FIG. 1. Alternatively, one or both of arm portions 14, 16 may include tapering and/or flaring over at least a portion of their lengths.

Scarf 10 may include an interior side 18, which generally may rest against the user's body and an exterior side 20 opposite interior side 18 and facing away from the user. These designations are for description and reference only, as it clearly may be possible to rest at least a portion of the exterior side 20 against the user during use.

At least one, and preferably both, of first and second arm portions 14, 16 may include at least one pocket 22, which may be used for storage or as a receptacle for the user's hands. Preferably, both arm portions include a pocket 22 in substantially the same position on each arm portion. Each pocket may include an opening sized to receive the user's hands comfortably. Opening 24 into each pocket 22 may point upward, rearward, or both, as seen in FIGS. 2-3. In one embodiment, opening 24 may include a closure device, such as a zipper, snap, or button. In another embodiment, opening 24 may remain open, without any kind of closure. In addition, scarf 10 may include an additional pocket 26 disposed within at least one pocket 22.

Pockets 22 may be disposed at a height that allows for a plurality of users of different heights and/or arm lengths to wear scarf 10 and to use pockets 22 comfortably. For example, middle of pockets 22 may be disposed generally at waist height for an average sized person, but pockets may have a large enough depth to accommodate users with different arm lengths. Bottoms of pockets 22 may be between about 20 inches and about 40 inches from a transition between neck portion 12 and first and second arm portions 14, 16, preferably between about 24 inches and about 30 inches, and in one embodiment, about 28 inches. Pockets may be between about 4 inches and about 12 inches deep, preferably between about 6 inches and about 10 inches deep, and in one embodiment, about 8½ inches deep.

Scarf 10 may be sized such that pockets 22 may be proximate first and second ends 15, 17, although one or more of first and second arm portions 14, 16 may extend a significant distance beyond a bottom of the pockets 22.

Turning back to FIG. 1, scarf 10 additionally may include one or more internal pockets 28. Because pocket 28 may be disposed inward from interior side 18, this pocket 28 may be better suited for storing items of greater importance to the user, e.g., identification, money, etc. Pocket 28, therefore, may have a closure device to assist in retaining items within pocket 28, e.g., a zipper, one or more buttons or snaps, etc. Preferably, closure device is a zipper, which may enable the entire pocket opening to be sealed.

Pocket 28 may be disposed closer to neck portion 12 than pockets 22, e.g., mimicking a breast pocket on a coat, making it easier for the user to store and retrieve items from pocket 28.

Scarf 10 additionally may include a chamois-type portion 30 disposed on interior side 18, e.g., opposite one of exterior pockets 22 or proximate a first or second end 15, 17. Chamois may be made of a microfiber, cotton, or other material that may adequately clean glass or plastic without scratching it. Preferably, chamois-type portion 30 is disposed far enough down its arm portion that a user can employ it to easily clean an object such as glasses, a cell phone or computer tablet-type device screen, etc., while wearing scarf 10.

Turning now to FIGS. 1A-B, scarf 10 may include one or more inflatable bladders 32. Preferably, bladder 32 is disposed within internal pocket 34 within neck portion 12. Bladder 32 may be operatively coupled to tube 36, e.g., proximate one end of bladder 32. As seen in FIGS. 1A-B, bladder 32 and tube 36 may be fixedly coupled to one another, although tube 36 alternatively may be designed to be separable from bladder 32.

Figure 4:
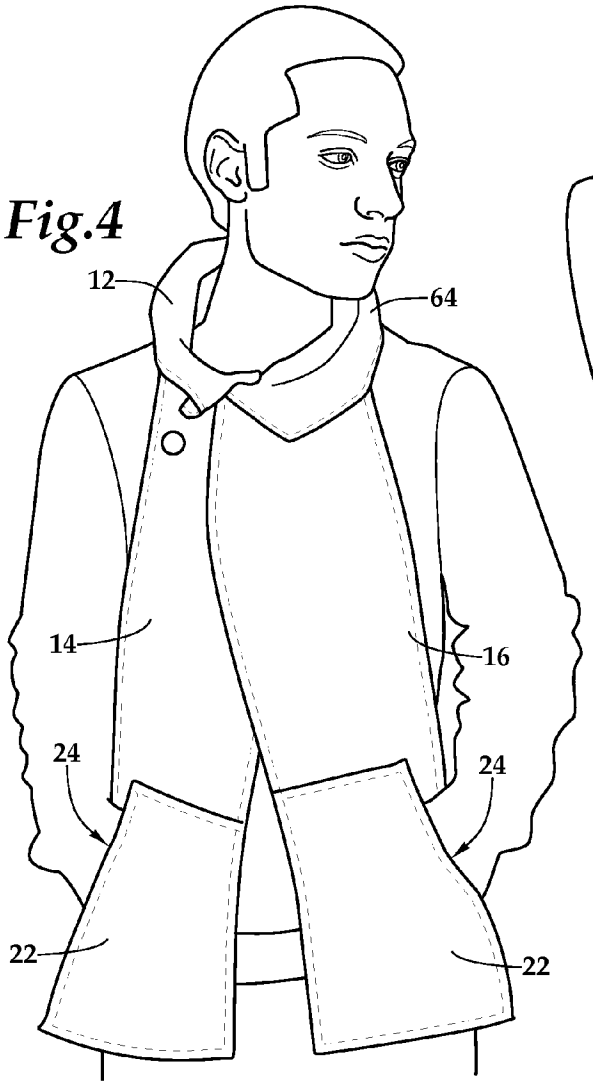
FIG. 4 is a front view of the apparel of FIG. 1 worn around the neck of a user with the bladder deflated.

Bladder 32 may span a substantial height of neck portion 12. As such, bladder 32 may be made of a relatively thin, flexible material so that when the bladder is deflated, the user may be able to fold neck portion 12 over, forming a collar, without the bladder attempting to return to an unfolded configuration, as seen in FIG. 4.

Bladder 32 also may span a substantial amount of the width of neck portion. In one embodiment, bladder 32 spans at least the part of neck portion 12 located laterally inwards between arm portions 14, 16. Additionally, bladder 32 may have a lateral extent overlapping onto width of arm portions 14, 16. As seen in FIG. 1, bladder 32 may extend widthwise to about the median width of arm portions 14, 16.

Neck portion 12 may include an inner arch 38 for resting on the user's neck during use. Additionally, neck portion 12 may include an outer arch 40 Inner and outer arches may have similar radii of curvature. Staying with FIG. 1, however, inner arch 38 may have a smaller radius of curvature than outer arch 40. As such, neck portion may be narrowest proximate the apex of the arches and may widen when expanding outward toward arm portions 14, 16.

Bladder 32 may be configured to generally match the contours of neck portion 12, i.e., it may be narrowest at an apex and expand towards its ends, as seen in FIG. 1A. Alternatively, bladder 32 may have a generally uniform thickness along its length, as seen in FIG. 1B. In one embodiment, neck portion 12 may be about 7" thick at its apex, or generally about as thick as a width of arm portions 14, 16. When deflated, bladder 32 may be narrower than this, e.g., about 4½" wide at its apex, which may allow for expansion of bladder within internal pocket 34 of neck portion 12 as bladder 32 is inflated. Deflated bladder 32 may have a width of about 6½" proximate its ends. Moreover, bladder 32 may have one or more radii of curvature substantially similar to radii of curvature of inner and outer arches 38, 40. These dimensions are exemplary and bladders with other dimensions and/or dimensional ratios are possible.

As stated above, bladder 32 may be operatively coupled to tube 36. Tube 36 may travel within channel 42 from neck portion 12 into one of arm portions 14, 16. Tube 36 may terminate in a fill valve 44, which may exit channel at port 46 on the arm portion. Tube may be between about 6" and about 24" long, preferably between about 8" and about 16", and in one embodiment, about 10". As such, fill valve 44 may extend down into arm portion 14 a sufficient distance that it may be used easily by user while wearing scarf 10. For example, a shorter tube—which correlates with a port higher up on arm portion or on neck portion—may require the user to bend his or her head at a severe angle to reach tube. Additionally, with a shorter tube, valve then may be at a location where it presses against the user's neck or head when bladder 32 is inflated, which may lead to discomfort. Instead, port 46 may be located a vertical distance between about 4" and about 12" from inner arch 38 of neck portion 12, preferably between about 5" and about 9", and in one embodiment, about 7".

Although a single bladder-tube combination has been described herein, scarf 10 may include a plurality of bladders and/or tubes or a single bladder having multiple separate chambers fillable by separate tubes. For example, scarf may include first and second bladders or a bladder having a first and second chamber disposed laterally adjacent to one another with separate tubes to fill each portion. As such, the user may be able to adjust each bladder to a desired level for increased customization. In this example, the user may wish to sleep more on his or her side, so the user may inflate the side that will be underneath the head while not inflating the other side or inflating it to a lesser degree. Alternatively, a plurality of bladders may be arranged generally vertically with respect to one another so as to allow the user to provide increased or decreased cervical or head support. Tubes for the plurality of bladders may extend through the same channel 42 and exit port 46, or scarf may include a plurality of channels, such as a second channel leading to the other arm portion, and a plurality of exit ports with covers.

Fill valve 44 may retract within port 46 when not being used to inflate or deflate bladder 32, concealing fill valve 44 during use. Alternatively, scarf 10 may include cover 48 to conceal fill valve 44. Cover and arm portion may include interfacing attachment mechanisms 50, e.g., Velcro, snaps, buttons, tabs/slots, etc., to keep cover 48 in place. Additionally, cover 48 may be made of the same material (including color, fabric pattern, etc.) as arm portion 14 to further conceal cover. In yet another embodiment, cover 48 may remain generally stationary with respect to arm portion 14, as in the case of a patch over port 46 that is coupled to arm portion at all but one side. Cover 48 then may conceal fill valve 44 while allowing for access to fill valve via the uncoupled part of cover 48.

Bladder 32 and/or tube 36 may be removable from within scarf 10. Neck portion 12 may include an opening 52 through which bladder 32 and tube 36 may pass into and out of pocket 34. Opening 52 may be resealable, e.g., via use of a zipper 54 or other type of closure device. In one embodiment, opening 52 may be disposed on interior side 18 of neck portion 12, thereby concealing opening 52. Alternatively, opening 52 may be disposed along exterior side 20 of neck portion. This may prevent the zipper pull from contacting and/or pressing into the user's head or neck, which may cause discomfort for some users.

Scarf 10 also may include an increased friction element 56 such as a rubber-type portion on an exterior side of neck portion 12, e.g., in a spot overlying bladder 32. Element 56 may be generally centered on neck portion and may be made of a suitable material to help prevent scarf from sliding when the user turns his or her head and when the scarf is pressed against a surface, such as a chair back or headrest. Element 56 may be large enough to provide increased friction but small enough so as to avoid creating unwanted rigidity in neck portion 12, e.g., element 56 may be between about 1"×1" and about 2"×2".

Scarf 10 may be made of a variety of different materials. In one embodiment, scarf 10 may include at least a portion of a LYCRA or polyester/cotton blend material with rayon, which may impart a slight degree of stretch into the scarf. This may allow for expansion of scarf 10 as bladder 32 is inflated. Alternatively, internal bladder pocket 34 may be sized to accommodate fully inflated bladder 32, which may decrease importance of fabric stretch.

Figure 6:
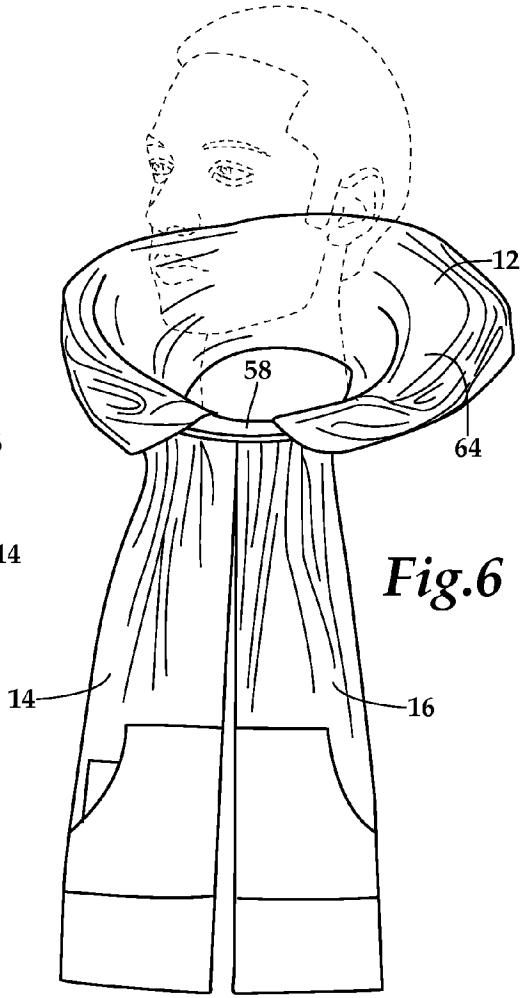
FIG. 6 is a front view of the apparel of FIG. 1 worn around the neck of a user with the bladder inflated.
Figure 5:
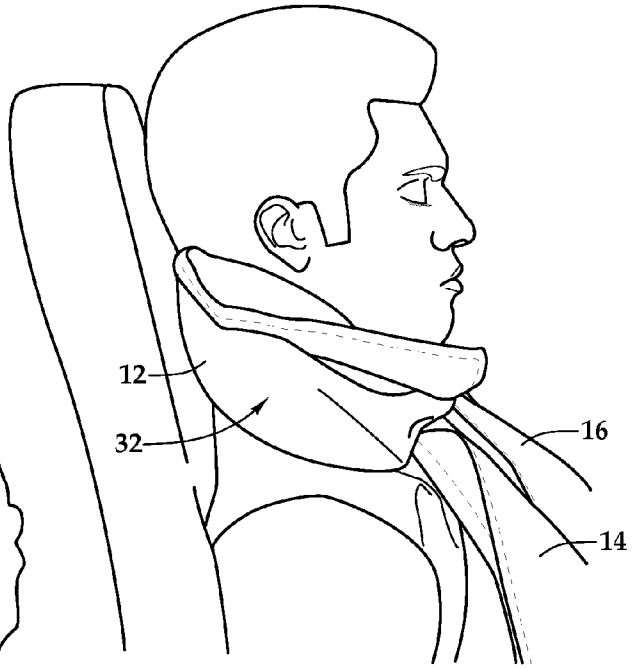
FIG. 5 is a side view of the apparel of FIG. 1 with the bladder of the neck pillow inflated.
Figure 8:
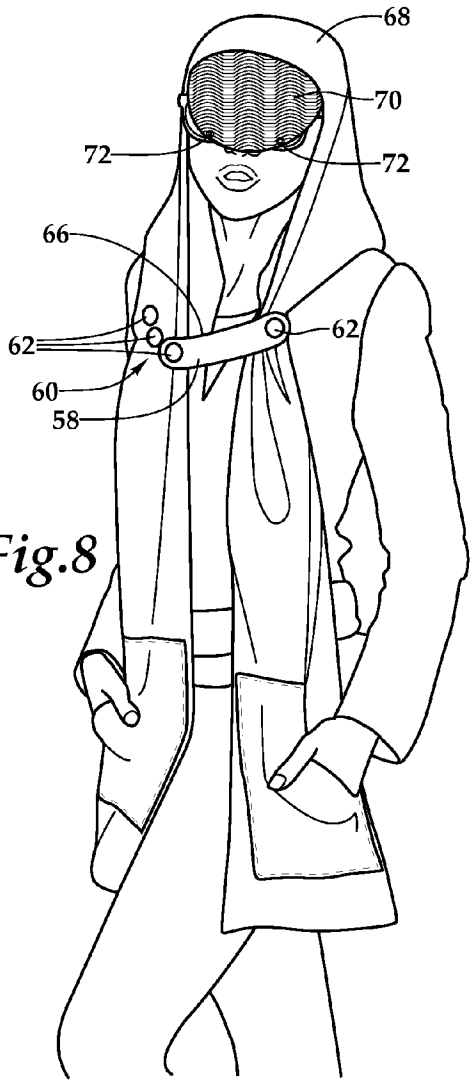
FIG. 8 is a front view of the apparel of FIG. 7 with a visor portion extending downward from the hood to cover at least a portion of the user's face.
Figure 7:
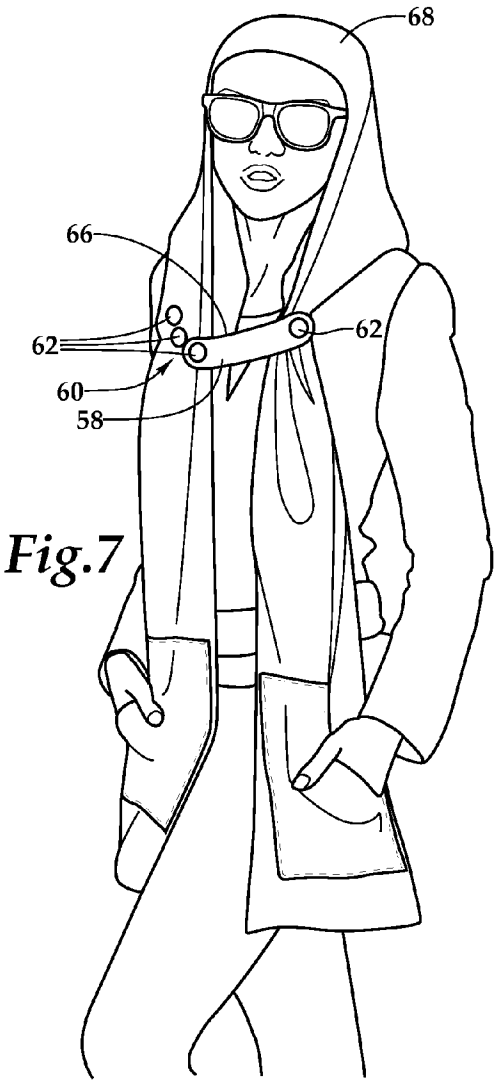
FIG. 7 is a front view of a second embodiment of apparel with an inflatable neck cushion, including a hooded portion.

Turning now to FIGS. 6-8, scarf 10 further may include a coupler 58 to releasably couple arm portion 14 to arm portion 16. Coupler 58 may include a fabric portion similar to fabric of arm portions 14, 16. Alternatively, coupler 58 may include decorative attachments to provide for different aesthetic appearances.

Coupler 58 and arm portions 14 also may include attachment means 60, such as buttons and eyelets, snaps, Velcro, latches, ties, stitching, etc. Coupler 58 may be fixedly attached to one or both of arm portions, removably attached to one or both of arm portions, or fixedly attached to one arm portion and removably attached to the other arm portion. Coupler 58 may be sized to keep arm portions relatively close to one another to pull ends of bladder 32 together, but not so close as to pinch around the user's neck. For example, coupler 58 may be about 6 inches long with eyelets of attachment means spaced about 4 inches apart, although alternative dimensions are possible.

Preferably, attachment means 60 may comprise one or more buttons 62 on each of arm portions 14, 16 and a plurality of openings on coupler 58. In the embodiment seen in FIGS. 7-8, arm portion 16 includes a single button and arm portion 14 includes a plurality of buttons, which may allow for adjustment of scarf 10 for various-sized users. Buttons 62 may be located such that, when joined to both arm portions, scarf 10 with coupler 58 may form a collar 64 around the user's neck, proximate the user's collarbone, as seen in FIG. 6. Coupler 58 may include a radius of curvature 66 on an upper portion, which may lay more comfortably against the user in the event of a tighter fit than if coupler had a different configuration, e.g., a straight line or convex.

Buttons 62 may be arranged in one or more ways. For example, buttons may be generally vertically aligned with respect to arm portion 14, as seen in FIG. 2. Alternatively, buttons may be angled relative to arm portion 14, as seen in FIG. 3. This may allow for a larger degree of adjustment, as collar 64 may change a greater amount when using angled buttons as compared to generally vertical alignment. In one embodiment, buttons 62 may be angled about 35 degrees relative to a leading edge of arm portion 14, although other angle variations are possible. Buttons 62 also may be disposed proximate ends of bladder, as seen in FIG. 2 or outward from bladder 32, as seen in FIG. 3.

Without coupler 58, bladder 32 may tend to flare outwards at its ends, decreasing support or cushioning for the user. Additionally, the closer buttons 62 arelocated with respect to bladder ends, the more countoured bladder 32 will be around the user's neck, providing enhanced support to more of the user's neck.

Second arm portion 16 also may include a plurality of buttons, which may provide even greater adjustability for the user. Alternatively, second arm portion 16 may include a single button, so the user only has to adjust one side in order to adjust collar 64.

Figure 9:
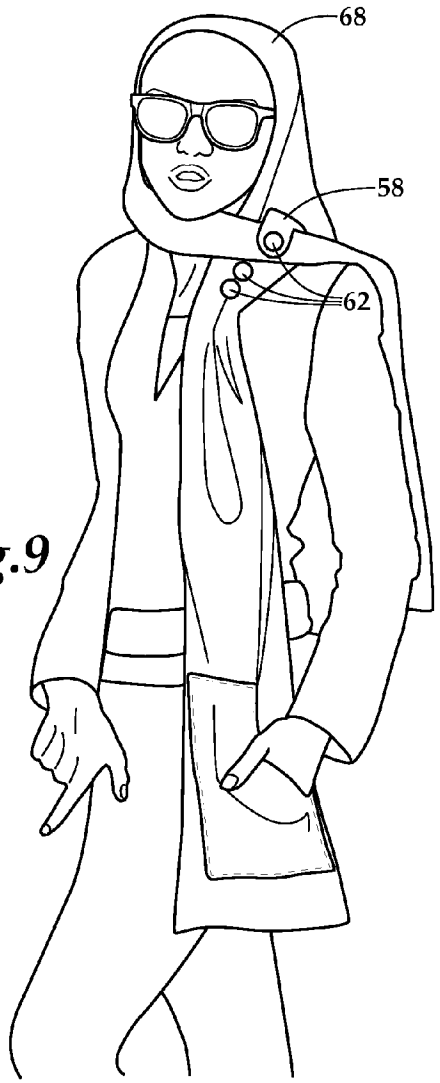
FIG. 9 is a front view of the apparel of FIG. 7 with the arm portions in an alternative configuration.

Coupler 58 also may be employed when bladder is deflated to provide for different scarf configurations for the user. As seen in FIG. 7, coupler may be joined across the front of the user, with arm portions 14, 16 generally adjacent to one another. Alternatively, as seen in FIG. 9, arm portion 14 may be crossed over arm portion 16, such that arm portion 14 provides greater coverage for the user's neck. In this configuration, coupler may be disposed to one side of the user's neck, contributing to a different look for the user. Other arm/coupler configurations are possible, including removing coupler entirely when bladder 32 is deflated.

In another embodiment, as seen in FIGS. 7-9, scarf 10 may include a hooded portion 68, which may serve as an extension of neck portion. Although bladder 32 and internal bladder pocket 34 may be enlarged to continue within at least a portion of hooded portion 68, preferably bladder and bladder pocket remain substantially the same as in the non-hooded embodiment. In this embodiment, scarf 10 further may include a visor or mask 70 having one end secured to hooded portion 68 and another end releasably coupled an underside of hooded portion 68, e.g., via fasteners 72. When uncoupled, visor 70 may cover at least a portion of the user's face, e.g., the eyes, nose, and/or mouth. Visor 70 may be made of a material that is at least partially opaque, which may serve one or more purposes. Visor 70 may shield the user's eyes from light in the event the user wishes to sleep or to have a darkened, more relaxing environment. Additionally, visor 70 may offer the user additional privacy while sleeping, as some people sleep with their mouths open and would prefer to avoid making that visible to other people.

In another embodiment, apparel 10 may comprise a vest. In yet another embodiment, apparel 10 may comprise a shirt or jacket with a collar. In a further embodiment, apparel 10 may comprise a hooded sweatshirt. Descriptions of the various aspects of the scarf may apply to these and other embodiments of the apparel 10. Although these different apparel embodiments may include more fabric than just neck and arm portions, they each may include a neck portion suitable for holding bladder, material extending downward from the neck portion in front of the user, and some form of coupling or other manner of holding this downward extending material together so as to form a collar around the user's neck.

To use scarf 10 as a neck pillow or supporter, the user may place neck portion 12 behind his or her neck, with arm portions 14, 16 draped in front. Coupler 58 may join arms together, and may be adjusted to a desired tightness for the user. The user then may open cover 48 and, if not already protruding, remove tube 36 from port 46. By blowing into fill valve 44, the user may inflate bladder 32 to the desired level. The user then may close fill valve 44 and close cover 48. In order to provide additional support to the user's neck, the user may insert his or her hands into pockets 22. Downward force in pockets 22 may pull arm portions 14, 16 forward, which further may pull neck portion 12 against the user's neck, causing neck portion to bend inward to a greater degree and providing a greater circumferential cushioning effect.

While the foregoing written description enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. Neck-supporting apparel, comprising:

a neck portion having an interior side and an exterior side with a pocket therebetween;

a first portion having an interior side designed to rest against a user's body during use and an exterior side designed to face away from the user during use, the first portion extending outward from an end of the neck portion and a second portion extending outward from another end of the neck portion;

a separate inflatable bladder designed to be disposed within the pocket;

a tube operatively connected to the bladder, the tube configured to extend through a channel in the first portion; and a coupler allowing the first portion to join with the second portion in front of a user;

wherein the channel extends to a port on the interior side of the first portion;

a cover concealing the port;

wherein the pocket is disposed in the neck portion only.

2. Neck supporting apparel according to claim 1, wherein the coupler is releasably couplable to at least one of the first and second portions.

3. Neck supporting apparel according to claim 1, wherein the coupler is releasably couplable to both of the first and second portions.

4. Neck supporting apparel according to claim 1, wherein the first portion includes a plurality of buttons, and the coupler includes an eyelet at one end, the eyelet configured to receive each of the plurality of buttons.

5. Neck supporting apparel according to claim 1, further comprising an opening on the exterior side of the neck portion, the opening providing access to the pocket.

6. Neck supporting apparel according to claim 1, wherein the port is vertically spaced at least about 6" from a median of the neck portion.

7. Neck supporting apparel according to claim 1, further comprising a hood extending from the neck portion.

8. Neck supporting apparel according to claim 1, further comprising an external pocket on an exterior side of each of the first and second portions.

9. A neck supporting scarf, comprising:

a neck portion with a first arm portion and a second arm portion;

a pocket on an exterior side of, and proximate a bottom of, the first arm portion and the second arm portion;

a separate inflatable bladder disposed within the neck portion;

a tube coupled at one end proximate an end of the bladder and having a valve at an opposite end;

a port on an interior side of one of the first and second arm portions, the port configured to receive the valve; and a channel extending from the neck portion through at least a portion of the first arm portion, the channel connecting the pocket and the port;

wherein the interior sides of the first and second portions are designed to rest against a user's body during use, and the exterior sides of the first and second portions are designed to face away from the user during use;

a cover concealing the port;

wherein the pocket is disposed in the neck portion only.

10. A neck supporting scarf according to claim 9, further comprising:

a connector configured to couple the first and second arm portions together; and attachment means on the first and second arm portions configured to couple to the connector.

11. A neck supporting scarf according to claim 10, wherein the attachment means on at least one of the first and second arm portions are disposed proximate an end of the bladder.

12. A neck supporting scarf according to claim 10, wherein the attachment means on at least one of the first and second arm portions are disposed in a position overlying the channel.

13. A neck supporting scarf according to claim 9, further comprising a hood extending from the neck portion.

14. A neck supporting scarf according to claim 13, further comprising a visor attached at one end to the hood and releasably attached to the hood at another end.

15. A neck supporting scarf according to claim 9, wherein the bladder flares outward toward its edges.

16. A neck supporting scarf according to claim 9, wherein the tube is about 10 inches long.

17. Neck supporting apparel, comprising:

a scarf, including:

a neck portion having an inner radius of curvature;

a plurality of arm portions extending from the neck portion, each arm portion having an interior side designed to rest against a user's body during use and an exterior side designed to face away from the user;

a pocket on an exterior side of each arm portion;

a separate inflatable bladder spanning within the neck portion, the bladder having a radius of curvature substantially similar to the neck portion radius of curvature;

a port on the interior side of one of the arm portions, the port configured to receive a fill valve, the fill valve configured to inflate and deflate the bladder;

at least one button on each arm portion, the buttons disposed below the ends of the bladder; and a coupler configured to join a button on a first arm portion with a button on a second arm portion;

a cover concealing the port;

wherein the pocket is disposed in the neck portion only.

18. Neck supporting apparel according to claim 17, further comprising:

a tube connecting the bladder to the fill valve, the tube extending downward into one of the arm portions, the tube having a length about half a length of the bladder.

* * * * *